US011818543B2

(12) United States Patent
Uvesten

(10) Patent No.: US 11,818,543 B2
(45) Date of Patent: Nov. 14, 2023

(54) VIBRO-TACTILE DIRECTIONALITY IN BONE CONDUCTION DEVICES

(71) Applicant: Cochlear Limited, Macquarie University (AU)

(72) Inventor: Carl Uvesten, Partille (SE)

(73) Assignee: Cochlear Limited, Macquarie University (AU)

( * ) Notice: Subject to any disclaimer, the term of this patent is extended or adjusted under 35 U.S.C. 154(b) by 0 days.

(21) Appl. No.: 17/636,975

(22) PCT Filed: Aug. 26, 2020

(86) PCT No.: PCT/IB2020/057977
§ 371 (c)(1),
(2) Date: Feb. 21, 2022

(87) PCT Pub. No.: WO2021/044259
PCT Pub. Date: Mar. 11, 2021

(65) Prior Publication Data

US 2022/0360910 A1 Nov. 10, 2022

Related U.S. Application Data

(60) Provisional application No. 62/895,068, filed on Sep. 3, 2019.

(51) Int. Cl.
*H04R 25/00* (2006.01)

(52) U.S. Cl.
CPC ..... *H04R 25/353* (2013.01); *H04R 25/356* (2013.01); *H04R 2225/41* (2013.01); *H04R 2225/53* (2013.01); *H04R 2460/13* (2013.01)

(58) Field of Classification Search
CPC ..... H04R 25/353; H04R 25/356; H04R 2225/41; H04R 2225/53; H04R 2460/13
See application file for complete search history.

(56) References Cited

U.S. PATENT DOCUMENTS 9,992,584 B2 6/2018 Hillbratt et al.
2002/0122563 A1 9/2002 Schumaier
(Continued)

FOREIGN PATENT DOCUMENTS

KR 10-2018-0090229 A 8/2018

OTHER PUBLICATIONS

International Search Report and Written Opinion in counterpart International Application No. PCT/IB2020/057977, dated Nov. 30, 2020, 13 pages.

(Continued)

*Primary Examiner* — Suhan Ni
(74) *Attorney, Agent, or Firm* — Edell, Shapiro & Finnan, LLC

(57) ABSTRACT

A bone conduction device located at the deaf ear of a recipient suffering from single-sided deafness is configured to receive sound signals within a spatial region proximate to the deaf ear of the recipient. The bone conduction device is configured to generate and deliver, based on the sound signals received within the spatial region, sound vibrations to the recipient. The sound vibrations are configured to evoke perception of the received sound signals at a cochlea of a second ear of the recipient. The bone conduction device is also configured to generate and deliver tactile vibrations to the recipient contemporaneously with the sound vibrations. The tactile vibrations generate a vibro-tactile sensation proximate to the deaf ear of the recipient, but the vibro-tactile sensation is non-perceivable (not heard) at the cochlea of the second ear of the recipient.

30 Claims, 6 Drawing Sheets

(56) References Cited

U.S. PATENT DOCUMENTS

| | | | | |
|---|---|---|---|---|
| 2010/0298626 | A1 | 11/2010 | Andersson et al. | |
| 2011/0081031 | A1 | 4/2011 | Abolfathi | |
| 2014/0364682 | A1 | 12/2014 | Hillbratt et al. | |
| 2015/0110322 | A1 | 4/2015 | Andersson | |
| 2015/0119635 | A1 | 4/2015 | Gustafsson et al. | |
| 2015/0156595 | A1 | 6/2015 | Zhong et al. | |
| 2015/0208183 | A1 | 7/2015 | Bern | |
| 2016/0112811 | A1 | 4/2016 | Jensen et al. | |
| 2017/0085998 | A1* | 3/2017 | Fritsch | H04R 25/505 |
| 2018/0078422 | A1 | 3/2018 | Dierenbach | |

OTHER PUBLICATIONS

Kendrick, Mandy, "Tasting the Light: Device Lets the Blind "See" with Their Tongues", https://www.scientificamerican.com/article/device-lets-blind-see with-tongues/, Aug. 13, 2009, 6 pages.

Williams, Amanda, "Colour blind artist becomes world's first 'eyeborg' by having antenna implanted inside his skull so he can 'hear' colours", https://www.dailymail.co.uk/sciencetech/article-2582019/Colour-blind-artist-worlds-eyeborg-having-antenna-implanted-inside-skull-hear-colours.html, Mar. 16, 2014, 27 pages.

Merriman, Helena, "The blind boy who learned to see with sound", https://www.bbc.com/news/disability-35550768, Feb. 12, 2016, 12 pages.

Extended European Search Report in counterpart European Application No. 20859820.1-1207, dated Sep. 7, 2023, 7 pages.

* cited by examiner

LEGEND:

| | |
|---|---|
| DEAF EAR | × |
| FUNCTIONAL EAR | ✓ |
| FUNCTIONAL HEARING REGION (BOUNDARY) | ----- |
| SIDE-BEAMFORMING REGION (BOUNDARY) | ..... |

VIBRO-TACTILE DIRECTIONALITY IN BONE CONDUCTION DEVICES

BACKGROUND

Field of the Invention

The present invention relates generally to bone conduction devices for single-sided deafness (SSD).

Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Unilateral hearing loss (UHL) or single-sided deafness (SSD) is a specific type of hearing impairment where an individual has one deaf ear and one contralateral functional ear (i.e., one partially deaf, substantially deaf, completely deaf, non-functional and/or absent ear and one functional or substantially functional ear that is at least more functional than the deaf ear). Individuals who suffer from single-sided deafness experience substantial or complete conductive and/or sensorineural hearing loss in their deaf ear.

SUMMARY

In one aspect, a method is provided. The method comprises, at a bone conduction device positioned at a deaf ear of a recipient: receiving sound signals within a spatial region proximate to the deaf ear of the recipient; delivering sound vibrations to the recipient, wherein the sound vibrations are generated based on the sound signals received within the spatial region and are configured to evoke perception of the sound signals at a cochlea of a contralateral ear of the recipient; and delivering tactile vibrations to the recipient contemporaneously with the sound vibrations, wherein the tactile vibrations are non-perceivable at the cochlea of the contralateral ear of the recipient.

In another aspect, a method is provided. The method comprises: receiving sound signals at a bone conduction device positioned at a first ear of a recipient; delivering, with the bone conduction device, sound vibrations to the recipient, wherein the sound vibrations are configured to evoke perception of the received sound signals at a second ear of the recipient; generating, with the bone conduction device, tactile vibrations based on the sound signals; and delivering, with the bone conduction device, the tactile vibrations to the recipient contemporaneously with the sound vibrations.

In another aspect, a bone conduction device is provided. The bone conduction device comprises: one or more sound input elements configured to receive sound signals within a spatial region proximate to a first ear of a recipient; an actuator; a processing unit and amplifier collectively configured to: convert the sound signals into one or more sound output signals for use in driving the actuator to evoke perception of the received sound signals at a cochlea of a second ear of the recipient; and generate vibro-tactile output signals for use in driving the actuator to evoke a vibro-tactile sensation proximate to the first ear of the recipient.

In another aspect one or more non-transitory computer readable storage media encoded with instructions are provided. The instructions, when executed by a processor, cause the processor to: generate, based on sound signals received at a bone conduction device positioned at a deaf ear of a recipient, one or more sound output signals for use in driving an actuator to generate sound vibrations, wherein the sound signals are received only within a spatial region adjacent to the deaf ear of the recipient and wherein the one or more sound output signals are configured such that the sound vibrations are generated at one or more frequencies to evoke perception of the sound signals at a cochlea of a contralateral ear of the recipient; and generate one or more vibro-tactile output signals for use in driving the actuator to generate tactile vibrations contemporaneously with the sound vibrations, wherein the one or more vibro-tactile output signals are configured such that the tactile vibrations are generated at one or more frequencies that are lower than the one or more frequencies of the sound vibrations.

BRIEF DESCRIPTION OF THE DRAWINGS

Embodiments of the present invention are described herein in conjunction with the accompanying drawings, in which.

DETAILED DESCRIPTION

Individuals suffering from single-sided deafness have difficulty, for example, with hearing conversation on their deaf side, localizing sound, and understanding speech in the presence of background noise, such as in cocktail parties, crowded restaurants, etc. In particular, the normal two-sided human auditory system is oriented for the use of specific cues that allow for the localization of sounds, sometimes referred to as "spatial hearing." Spatial hearing is one of the more qualitative features of the auditory system that allows humans to identify both near and distant sounds, as well as sounds that occur three hundred and sixty (360) degrees (°) around the head. However, the presence of one deaf ear and one functional ear, as is the case with single-side deafness, creates confusion within the brain regarding the location of the sound source, thereby resulting in the loss of spatial hearing.

In addition, the "head-shadow effect" causes problems for individuals suffering from single-sided deafness. The head-shadow effect refers to the fact that the deaf ear is in the acoustic shadow of the contralateral functional ear (i.e., on the opposite side of the head). This presents difficulty with speech intelligibility in the presence of background noise, and it is oftentimes most prevalent when the sound signal source is presented at the deaf ear and the signal has to cross over the head and be heard by the contralateral functional ear.

Accordingly, presented herein are techniques for assisting a recipient suffering from single-sided deafness with localizing sound signals (e.g., determining the relative direction of a source of the sound signals). More specifically, a bone conduction device located at the deaf ear of a recipient suffering from single-sided deafness is configured to receive sound signals within a spatial region proximate to the deaf ear of the recipient. The bone conduction device is configured to generate and deliver, based on the sound signals received within the spatial region, sound vibrations to the recipient. The sound vibrations are configured to evoke perception of the received sound signals at a cochlea of a second ear of the recipient. The bone conduction device is also configured to generate and deliver-tactile vibrations (vibro-tactile feedback) to the recipient contemporaneously with the sound vibrations. The tactile vibrations generate a vibro-tactile sensation proximate to the deaf ear of the recipient, but is non-perceivable at the cochlea of the second ear of the recipient. As used herein, "non-perceivable" at the cochlea of the second (contralateral) ear of the recipient means that the tactile vibrations do not evoke an audible hearing sensation at the cochlea of the second (contralateral) ear of the recipient (i.e., the tactile vibrations do not cause perceptible movement of the fluid in the contralateral cochlea).

Figure 1A:
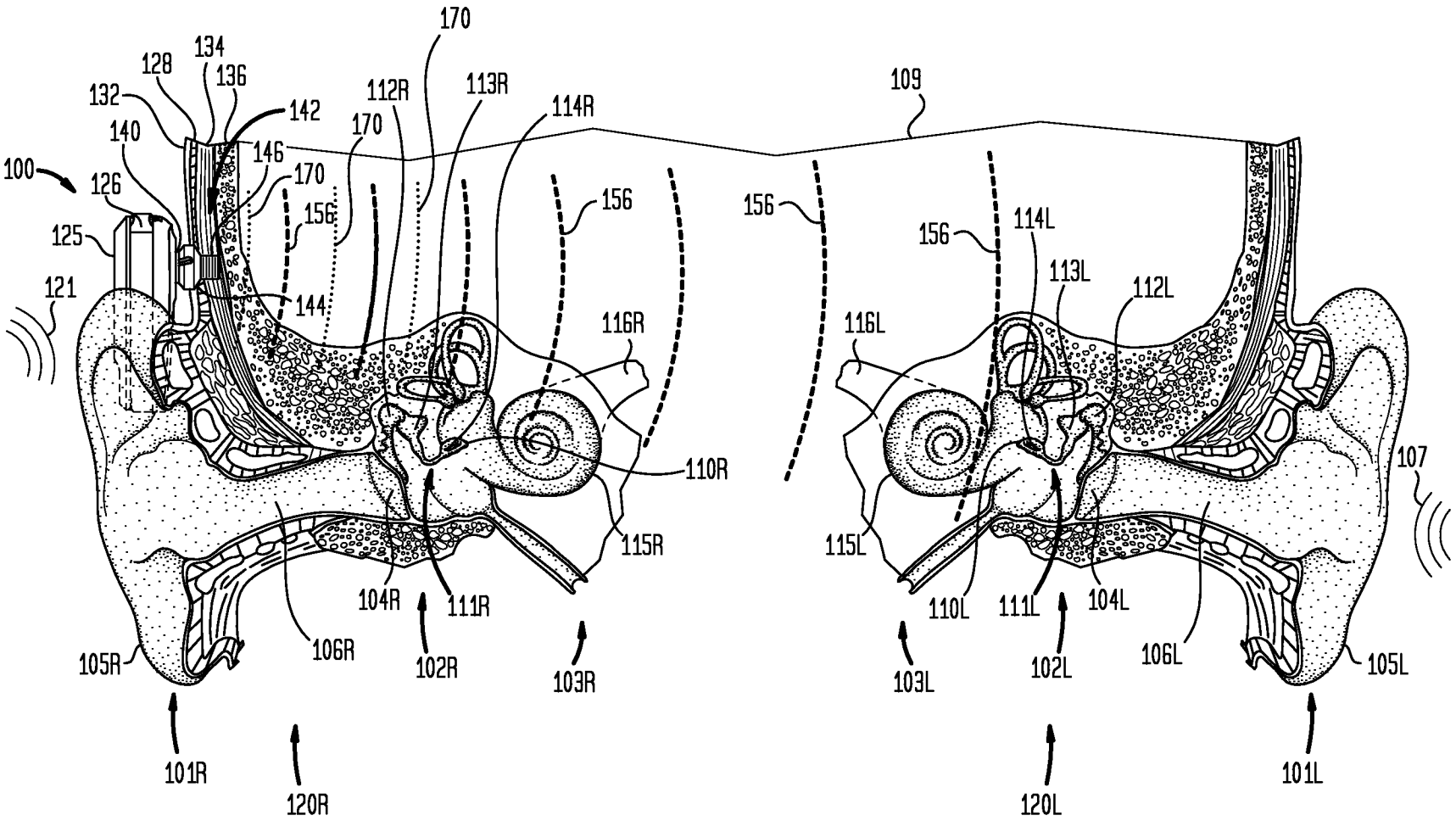
FIG. 1A is a perspective view of an exemplary bone conduction device in which at least some embodiments presented herein can be implemented.
Figure 1B:
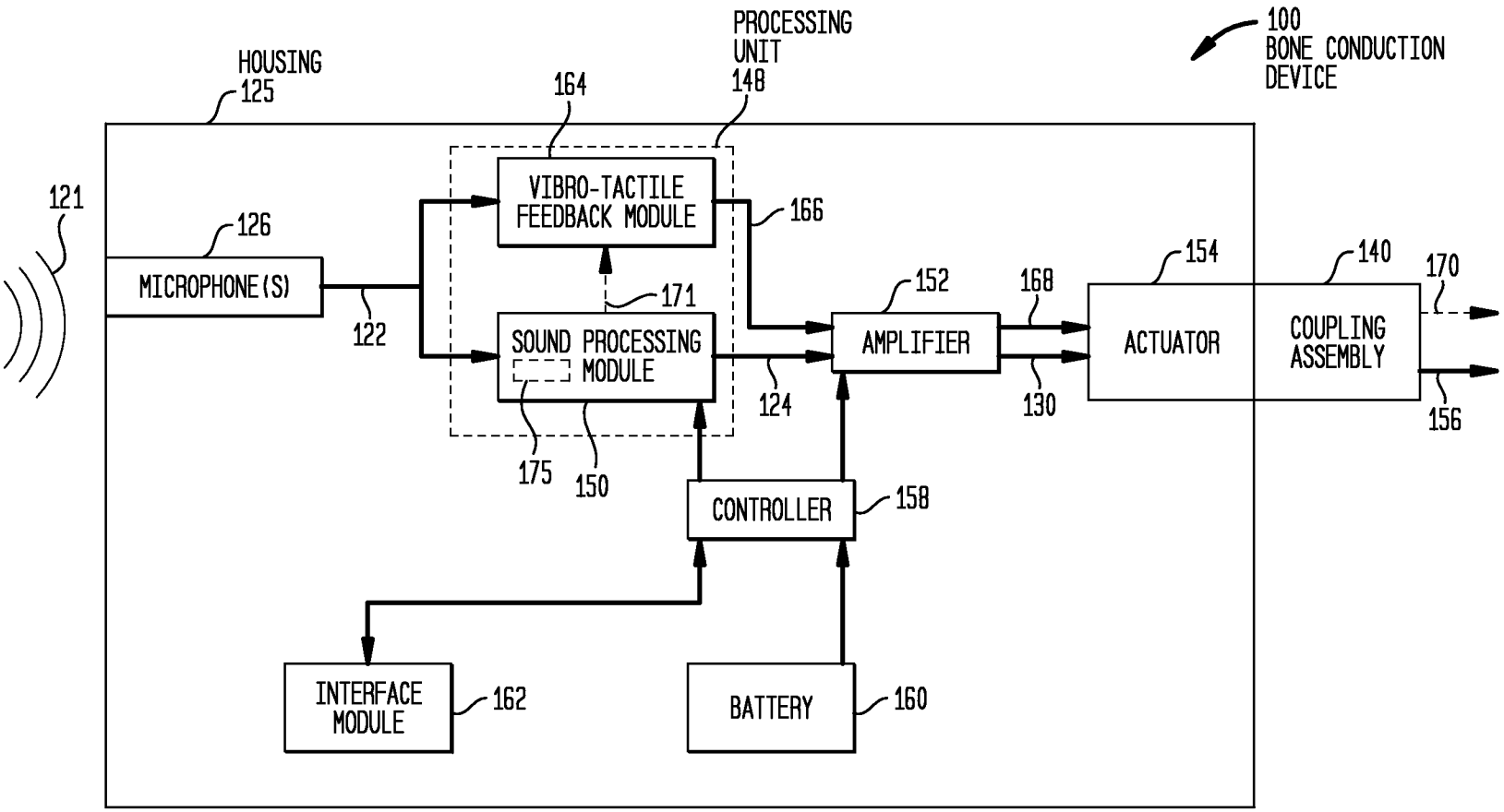
FIG. 1B is a functional block diagram of an embodiment of a bone conduction device, in accordance certain embodiments presented herein.

FIG. 1A is a perspective view of a bone conduction device 100 in which certain embodiments presented herein may be implemented, while FIG. 1B is a block diagram of the bone conduction device 100. For ease of description, FIGS. 1A and 1B will be described together.

The bone conduction 100 is shown, in FIG. 1A, in use with a recipient 109 suffering from single-sided deafness (SSD), where the recipient 109 has a deaf right ear (deaf ear or first ear) 120R and a functional left ear (functional ear or second ear) 120L. Before describing operation of the bone conduction device 100, the hearing anatomy of recipient 109 is described first below.

Referring first to the functional ear 120L, the recipient 109 has an outer ear 101L, a middle ear 102L and an inner ear 103L. In a fully functional human hearing anatomy, outer ear 101L comprises an auricle 105L and an ear canal 106L. A sound wave or acoustic pressure 107 is collected by auricle 105L and channeled into and through ear canal 106L. Disposed across the distal end of ear canal 106L is a tympanic membrane 104L which vibrates in response to acoustic wave 107L. This vibration is coupled to oval window or fenestra ovalis 110L through three bones of middle ear 102L, collectively referred to as the ossicles 111L and comprising the malleus 112L, the incus 113L and the stapes 114L. The ossicles 111L of middle ear 102L serve to filter and amplify acoustic wave 107, causing oval window 110L to vibrate. Such vibration sets up waves of fluid motion within cochlea 115L. Such fluid motion, in turn, activates hair cells (not shown) that line the inside of cochlea 115L. Activation of the hair cells causes appropriate nerve impulses to be transferred through the spiral ganglion cells and auditory nerve 116L to the brain (not shown), where they are perceived as sound.

The deaf ear 120R also includes: an outer ear 101R with an auricle 105R, an ear canal 106R, and a tympanic membrane 104R; middle ear 102R with ossicles 111R (i.e., malleus 112R, incus 113R and the stapes 114R); and an inner ear 103R with an oval window 110R and a cochlea 115R. However, unlike in the functional ear 105L, the cochlea 115R of deaf ear 120R is deaf (non-functional), meaning that the cochlea 115R is unable to generate nerve impulses to be transferred through the spiral ganglion cells to the auditory nerve 116R. The cochlea 115R may be deaf as a result of sensorineural hearing loss due to the absence or destruction of the hair cells in the cochlea 115R that transduce the sound signals (i.e., waves of fluid motion within cochlea 115R) into the nerve impulses As noted, FIG. 1A also illustrates the bone conduction device 100 which is positioned at the recipient's deaf ear 120R. That is, as shown, bone conduction device 100 is positioned behind outer ear 101R of the recipient 109 and comprises one or more sound input devices 126 to receive sound signals. In the examples of FIGS. 1A and 1B, the sound input elements comprise one or more microphones 126, but the sound input elements comprise additional sound input devices (e.g., a telecoil, audio input, etc.) which, for ease of illustration, have been omitted from FIGS. 1A and 1B. The one or more microphones 126 may be located, for example, on or in bone conduction device 100. Alternatively, the one or more microphones 126 could be located on a cable extending from bone conduction device 100, physically separated from the bone conduction device (e.g., an in-the-ear microphone in wireless communication with the bone conduction device), etc.

In an exemplary embodiment, bone conduction device 100 is an operationally removable component configured to be releasably coupled to a bone conduction implant (not shown in FIG. 1A). That is, the bone conduction device 100 can be attached/detached to/from the bone conduction implant by the recipient 109 (or other user) during normal use of the bone conduction device 100. Such releasable coupling is accomplished via a coupling assembly 140 that is configured to mechanically mate with the bone conduction implant.

In the example of FIG. 1A, the coupling assembly 140 is configured to be mechanically or magnetically coupled to a bone conduction implant 142 (sometimes referred to as an anchor system and/or a fixation system) implanted in the recipient 109. In the embodiment of FIG. 1A, the bone conduction implant 142 includes a percutaneous abutment 144 attached to a bone fixture 146 via a screw (not shown in FIG. 1A), where the bone fixture 146 is fixed to the recipient's skull bone 136. The abutment extends from the bone fixture 146 through muscle 134, fat 128 and skin 132 so that the coupling assembly 140 may be attached thereto. Such a percutaneous abutment provides an attachment location for the coupling assembly that facilitates efficient transmission of mechanical force (vibration) generated by the bone conduction device 100. Due to the use of the percutaneous abutment, the bone conduction device 100 is sometimes referred to as a "percutaneous bone conduction device."

As noted above, FIG. 1A illustrates a percutaneous bone conduction device 100. It is to be appreciated that certain aspects presented herein may be utilized with other types of bone conduction devices. For example, the techniques presented herein could be implemented in a "transcutaneous bone conduction device" that does not use a percutaneous abutment. Instead, the transcutaneous bone conduction device is held against the skin via a magnetic coupling (e.g., magnetic material and/or magnets being implanted in the recipient and the vibrator having a magnet and/or magnetic material to complete the magnetic circuit, thereby coupling the vibrator to the recipient).

Returning to the example of FIGS. 1A and 1B, the bone conduction device 100 includes a housing 125 in which a processing unit 148, an amplifier 152, an actuator 154, a controller (control circuit) 158, at least one battery 160, and an interface module 162 are disposed. As described further below, the processing unit 148 comprises a sound processing module 150 and a vibro-tactile feedback module 164. The at least one battery 160 provides electrical power to the various components of bone conduction device 100. For ease of illustration, battery 160 has been shown connected only to controller 158. However, it should be appreciated that battery 160 may be used to supply power to any electrically powered circuits/components of bone conduction device 100, including sound processing module 150, amplifier 152, actuator 154, etc.

The processing unit 148, the sound processing module 150, and the vibro-tactile feedback module 164 may each comprise one or more processors (e.g., one or more Digital Signal Processors (DSPs), one or more uC cores, etc.), firmware, software, etc. arranged to perform operations described herein. That is, the processing unit 148, the sound processing module 150, and the vibro-tactile feedback module 164 may each be implemented as firmware elements, partially or fully implemented with digital logic gates in one or more application-specific integrated circuits (ASICs), partially in software, etc.

Bone conduction device 100 further includes the interface module 162, which allows the recipient 109 or other user to interact with the device 100. For example, interface module 162 may allow the recipient 109 to adjust the volume, alter the speech processing strategies, power on/off the device, etc. Again, for ease of illustration, interface module 162 has been shown connected only to controller 158.

In the embodiment illustrated in FIG. 1B, the components (e.g., microphone(s) 126, actuator 154, etc.) have all been shown as integrated into a single housing, referred to as housing 125. However, it should be appreciated that in certain embodiments of the present invention, one or more of the illustrated components may be housed in separate or different housings. Similarly, it should also be appreciated that in such embodiments, direct connections between the various modules and devices are not necessary and that the components may communicate, for example, via wireless connections.

In the example of FIGS. 1A and 1B, the microphone(s) 126 are configured to receive sound signals (sound) 121, and to convert the received sound signals 121 into electrical signals 122. If other sound input devices are present, the sound signals 121 could also or alternatively be received as an electrical signal.

As shown in FIG. 1B, electrical signals 122 are output by the microphone(s) 126 to the sound processing module 150. The sound processing module 150 is configured to convert the electrical signals 122 into adjusted/processed electrical signals 124. That is, the sound processing module 150 is configured to apply one or more processing operations (e.g., filtering, noise reduction, automatic gain control/adjustment, loudness compression, etc.) to the electrical signals 122. In certain embodiments, the sound processing module 150 may comprise a digital signal processor.

The processed electrical signals 124 are provided to the amplifier 152. The amplifier 152 amplifies (i.e., increases the time-varying voltage or current) the processed electrical signals 124 to generate amplified output signals 130, sometimes referred to herein as "sound vibration control signals" 130. The sound vibration control signals 130 are then used to drive (activate) the actuator 154 in a manner that causes the recipient 109 to perceive the sound signals 121. That is, using the sound vibration control signals 130, the actuator 154 generates a mechanical output force that is delivered to the skull of the recipient 109 via coupling assembly 140. Delivery of this output force causes one or more of motion or vibration of the recipient's skull, which are collectively and generally referred to herein as "sound vibrations" to the recipient's skull.

As noted, single-sided deafness (SSD) is a common condition in which a recipient has profound hearing loss in one ear (i.e., one ear is clinically deaf), but retains hearing in the contralateral ear (i.e., one ear is functional). When a bone conduction device, such as bone conduction device 100, is used to treat single-sided deafness, the bone conduction device 100 is configured to represent the received sound signals 121 as sound vibrations (i.e., vibrations representing the sound signals 121) that are sent/transmitted through the skull bone 136, from the deaf ear side of the head (i.e., proximate to deaf ear 120R) to the contralateral functional cochlea 115L (i.e., of functional ear 120L). The sound vibrations, which are represented in FIG. 1A by lines 156, set up waves of fluid motion within cochlea 115L. Such fluid motion, in turn, activates the hair cells inside of the cochlea 115L, which causes appropriate nerve impulses to be transferred through the spiral ganglion cells and auditory nerve 116L to the brain, where they are perceived as sound. As a result, the recipient 109 is able to perceive the sound signals 121 (albeit at the opposite side of the head from which they are received).

In general, the use of a bone conduction device 100 at the recipient's deaf ear 120R helps to address the head shadow effect leading to improved speech understanding (relative to an individual with untreated single-sided deafness) and an improved sound awareness approaching three hundred and sixty (360)-degrees. However, since all sound perception occurs via the single, healthy cochlea 115L, the recipient 109 is unable to localize the sound signals 121 based on the sound vibrations 156 alone. That is, since all sound is perceived from the left cochlea, regardless of where the sound signals 121 originate from, it is difficult for the recipient to determine the relative direction of the source of the sound signals 121 from the sound vibrations 156. This difficulty in localizing the sound signals 121 makes it difficult for the recipient 109 to understand speech over background noise and can be dangerous in that the recipient is unable to determine the direction of footsteps, traffic, alarms, etc. Additionally, certain recipient suffering from single-sided deafness report a sort of "audio numbness" even when using a bone conduction device at their deaf ear (i.e., a feeling as if the sound isn't really there).

Accordingly, presented herein are techniques for assisting recipients suffering from single-sided deafness with, for example, localizing sound signals (e.g., determining the relative direction of a source of the sound signals). More specifically, referring to the arrangement of FIG. 1A, in addition to the sound processing module 150, the bone conduction 100 comprises a vibro-tactile feedback module 164. The vibro-tactile feedback module 164 is configured to cause the amplifier 152 and actuator 154 to generate and deliver tactile vibrations, sometimes referred to herein as "vibro-tactile feedback," to the recipient 109. That is, the vibro-tactile feedback module 164 generates tactile output signals 166 that are provided to the amplifier 152. The amplifier 152 amplifies (i.e., increases the time-varying voltage or current) the tactile output signals 166 to generate "tactile vibration control signals" 168. The tactile vibration control signals 168 are then used to drive (activate) the actuator 154 in a manner that causes the recipient 109 to feel/sense tactile vibrations, which are represented in FIG.

1A by dashed lines 170, proximate to the deaf ear 120R. The recipient 109 would be able to feel this vibration via their skin (if using a transcutaneous solution) and/or via their bone. The vibration would not be instead of, but rather in addition to the sound vibrations 156 used to evoke perception of the sound signals 121. In this way, the recipient 109 is able to both feel and hear the sound originating on the deaf side.

In accordance with embodiments presented herein, the tactile vibrations 170 (vibro-tactile feedback) are delivered to the recipient 109 at one or more of a frequency or amplitude/magnitude (i.e., generated with a gain) that results in the recipient 109 "feeling" or "sensing" the tactile vibrations at a location that is proximate to the deaf ear 120L. However, the recipient does not hear the tactile vibrations at the functional ear 120L (that the tactile vibrations do not cause perceptible movement of the fluid in the contralateral cochlea 115L). That is, in FIGS. 1A and 1B, the recipient 109 experiences a vibro-tactile sensation (e.g., tingling) adjacent/proximate to the bone conduction device 100 (e.g., proximate to right ear 120R) upon the delivery of the tactile vibrations 170, but the tactile vibrations 170 do not evoke a hearing percept at the functional (contralateral) cochlea 115L (i.e., certain frequency levels and/or amplitudes of vibration leave the recipient 109 feeling the vibration of sound, rather than hearing the sound). This is in contrast to the sound vibrations 156, which evoke a hearing percept at the functional (contralateral) cochlea 115L, but which are not felt or sensed by the recipient 109 near the bone conduction device (i.e., the sound vibrations 156 do not evoke a perceptible vibro-tactile sensation).

As noted above, the tactile vibrations 170 cause the recipient 109 to feel a vibro-tactile sensation at a location that is adjacent/proximate to the bone conduction device 100. Since, in the case of single-sided deafness, the bone conduction device 100 is positioned adjacent to the deaf ear, the tactile vibrations 170 provide an indication of directionality to the recipient 109. That is, when the tactile vibrations 170 are delivered contemporaneously with the sound vibrations 156 (e.g., simultaneously or sequentially in a small period of time), the recipient's brain can associate the vibro-tactile sensation resulting from the tactile vibrations 170 with the perception of the sound signals 121, as evoked by the sound vibrations 156 at cochlea 115L.

As detailed above, since a recipient with single-sided deafness relies upon sound vibrations to transfer sound across the skull from the deaf ear to the functional ear, the tactile vibrations (vibro-tactile feedback) used to create the vibro-tactile sensation are configured so as not to mask or otherwise interfere with the recipient's perception of the sound signals through the sound vibrations (i.e., the tactile vibrations should not only be non-perceptible at the contralateral cochlea, but should not have attributes that affect perception of the sound vibrations). However, the tactile vibrations also have to be sufficient to generate the vibro-tactile sensation at the deaf ear. In accordance with embodiments presented herein, these requirements are satisfied by generating and delivering the tactile vibrations at amplitudes and/or frequencies that are different from the amplitudes and/or frequencies of the sound vibrations.

For example, in certain embodiments, the sound vibrations are associated with one or more frequencies and the tactile vibrations (vibro-tactile feedback) are generated at one or more frequencies that are below the frequencies associated with the sound vibrations. That is, in these embodiments, the sound vibrations have a frequency that is greater than the frequency of the tactile vibrations. The tactile vibrations and sound vibrations may have a frequency spacing (frequency difference) that is sufficient to ensure that the tactile vibrations do not mask or otherwise interfere with the recipient's perception of the sound signals through the sound vibrations.

As described further below, the frequency spacing between the tactile vibrations and sound vibrations may be recipient-specific (i.e., personalized/customized for the recipient). The frequency spacing may be determined, for example, during a fitting session where a clinician, audiologist, or other hearing professional which frequencies/gain that the recipient can feel proximate to the bone conduction device, but that do not irritate the recipient nor evoke a hearing perception at the contralateral ear.

In further embodiments, the sound vibrations are associated with one or more frequencies above a first threshold, while the tactile vibrations are associated with one or more frequencies below the first threshold. The first threshold may be, for example, an estimated minimum hearing threshold (an estimated minimum frequency of hearing) of the recipient (i.e., the tactile feedback is below the frequencies used for sound perception).

The estimated minimum frequency of hearing of the recipient may be determined, for example, based on data associated with other recipients, based on one or more objective assessments of the subject recipient's hearing, based on one or more subjective assessments of the subject recipient's hearing, etc. In certain examples, the recipient's estimated minimum frequency of hearing is approximately 500 Hertz (Hz) and, as such, in these embodiments the sound vibrations are associated with one or more frequencies above 500 Hz, while the tactile vibrations are associated with one or more frequencies below 500 Hz. It is to be appreciated that an estimated minimum frequency of hearing of 500 Hz is merely illustrative and that other thresholds are possible in accordance with examples presented herein.

In certain embodiments, the sound vibrations are generated with one or more first gains (volumes) and the tactile vibrations (vibro-tactile feedback) are generated at one or more gains (volumes) that are above the gains used to generate the sound vibrations. That is, in these embodiments, the sound vibrations are generated with a gain (e.g., at amplifier 152) that is greater than the gain (e.g., at also at amplifier 152) used to generate the tactile vibrations. The different gains used to generate the sound vibrations and the tactile vibrations is sufficient to ensure that the tactile vibrations do not mask or otherwise interfere with the recipient's perception of the sound signals through the sound vibrations. As noted above, the differences in gains between the sound vibrations and the tactile vibrations may be recipient-specific (e.g., determined during a fitting session).

In certain embodiments, the tactile vibrations are generated at a frequency, and in accordance with a gain/volume, to ensure that the tactile vibrations do not mask or otherwise interfere with the recipient's perception of the sound signals through the sound vibrations (i.e., the tactile vibrations are sub-threshold hearing, in terms of frequency, and above the typical amplitudes (higher gains) than used for sound perception). That is, not only the frequency, but also the gain/volume, at which the tactile vibrations are generated is selected to control the tactile vibrations in a manner that ensures that recipient can "feel," but not hear the vibro-tactile sensation (e.g., that create a sensation proximate to the deaf ear 120R, but are not perceived at the functional cochlear 115L).

Figure 2:
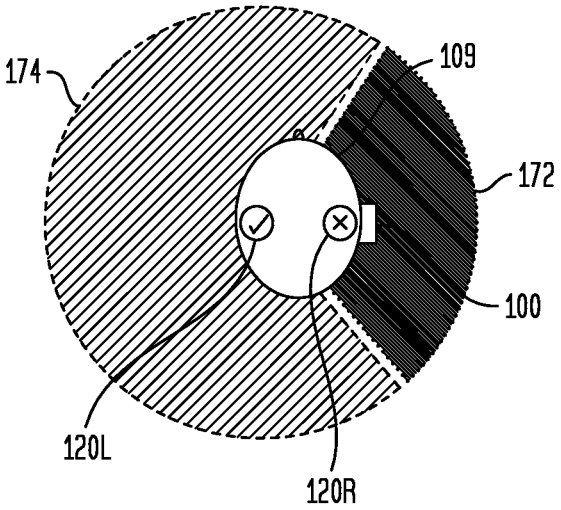
FIG. 2 is a schematic diagram illustrating operation of a bone conduction device in accordance with embodiments presented herein.

In certain embodiments, a bone conduction device, such as bone conduction device 100, is only configured to receive sound signals within a spatial region that is proximate to the deaf ear 120R of the recipient 109. For example, FIG. 2 is a schematic diagram illustrating the bone conduction device 100 worn at the deaf ear 120R of recipient 109. The bone conduction device 100 is configured to only detect sounds within a "side region" 172 that does not overlap with a "functional hearing region" 174 associated with functional ear 120L. The "functional hearing region" 174 is a two-dimensional representation of a spatial region in which the functional ear 120L of the recipient 109 is able to detect sounds (i.e., natural sound environment). As shown in FIG. 2, the bone conduction device 100 has a sensitivity/directionality so as to detect sounds only in the "side region" 172, which does not overlap with the functional hearing region 174. In other words, the side region 172 is a two-dimensional representation of the spatial region in which the bone conduction device 100 is able to detect sounds.

In the embodiment of FIG. 2, the bone conduction device 100 is configured to primarily detect sounds received within an angular spatial region that is centered at approximately one hundred and eighty (180) degrees from the contralateral ear (i.e., ninety degrees from the front of the recipient) and has an angular width of approximately ninety degrees (±45° in the front and rear directions) where the functional ear 120L of the single-sided deaf recipient 109 has difficulty detecting sounds. In another embodiment, the bone conduction device 100 is configured to detect sounds from angular region directed at direction of 150°±40°, with reference to the contralateral functional ear. In general, the bone conduction device 100 is configured to detect sounds within a spatial region that is proximate to the deaf ear 120L and that does not significantly overlap with the recipient's contralateral functional hearing (i.e., the directionality of the bone conduction 100 device is limited to a spatial region proximate to the recipient's deaf ear). As such, the bone conduction device 100 is sometimes referred to herein as having sensitivity in a spatial region that is "complimentary to" (i.e., assists/supports and generally does not interfere with) the hearing of the functional contralateral ear of the recipient at selected frequencies.

As noted above, the bone conduction device 100 may be configured to only detect sounds signals within side region 172 (i.e., the spatial region proximate to the recipient's deaf ear 120R). As a result, the bone conduction device 100 is configured to only generate the sound vibrations 156 when sound signals are detected within the side region 172. Similarly, the bone conduction device 100 is configured to only generate the tactile vibrations 170 (vibro-tactile feedback) when sound signals are detected within the side region 172. In this way, the recipient 109 is only provided with the tactile vibrations 170 when sound is detected at the deaf ear 120R of the recipient.

In certain embodiments, the tactile vibrations 170 (vibro-tactile feedback) are generated based on the sound signals received by the bone conduction device 100 (e.g., generated based on only sound signals received within side region 172). For example, the tactile vibrations 170 may be substantial copy of the sound vibrations 156, but at a lower frequency (e.g., a frequency-shifted version of the sound vibrations 156) and/or a higher gain. That is, the vibro-tactile feedback module 164 is configured to receive the electrical signals 122 that are output by the microphone(s) 126. The vibro-tactile feedback module 164 is configured to convert the electrical signals 122 into the tactile output signals 166, using operations similar to the sound processing module 150. However, the vibro-tactile feedback module 164 is configured to apply a downward frequency shift (e.g., compression) in generating the tactile output signals 166, relative to that applied by the sound processing module 150. The result is that the tactile output signals 166 are a substantial copy of the processed electrical signals 124 (i.e., represent the received sound signals 121), but at a lower frequency. In addition, the tactile output signals 166 may also indicate the use of a higher gain to the amplifier 152, relative to the processed electrical signals 124. Therefore, the content of both the tactile output signals 166 and the processed electrical signals 124 is substantially the same (i.e., both represent the received sound signals 121), but the tactile output signals 166 and the processed electrical signals 124 have different associated frequencies and gains. Accordingly, the sound vibrations 156 and the tactile vibrations 170 will also include substantially the same (i.e., both represent the received sound signals 121), but the sound vibrations 156 and the tactile vibrations 170 will be generated at different frequencies and different gains (as indicated in the signals 124 and 166, respectively).

In certain embodiments, the tactile vibrations 170 are generated, for example, with a frequency or gain that is selected/set based on one or more attributes of the sound signals. In certain embodiments, the tactile vibrations 170 (vibro-tactile feedback) are generated in accordance with one or more predetermined patterns.

As noted above, the tactile vibrations 170 are delivered to the recipient "contemporaneously with" the sound vibrations 156. As used herein, "contemporaneously with" means that the tactile vibrations 170 are delivered in close/small temporal (time) proximity to the sound vibrations 156. For example, in certain embodiments the tactile vibrations 170 may be delivered sequentially with the sound vibrations 156 (e.g., the sound vibrations 156 are delivered to the recipient, immediately followed by delivery of the tactile vibrations 170 or the tactile vibrations 170 are delivered to the recipient, followed immediately by delivery of the sound vibrations 156). In other embodiments, the tactile vibrations 170 may be delivered simultaneously or intermingled/intermixed with the sound vibrations 156 (e.g., alternatively deliver sound and tactile vibrations via the actuator 154).

FIG. 1B illustrates an embodiment in which one amplifier 152 and one actuator 154 are provided and used to deliver both the sound vibrations 156 and tactile vibrations 170. In alternative embodiments, multiple amplifiers and actuators may be present and used to separately deliver the sound vibrations 156 and tactile vibrations 170 to the recipient. In such arrangements, the sound vibrations 156 and tactile vibrations 170 could be delivered at the same time (e.g., each via a respective amplifier and actuator arrangement).

As noted above, the recipient 109 from single-sided deafness relies on the bone conduction device located at his/her deaf ear to transfer sound vibrations 156 to his/her functional ear. As such, also as noted above, the tactile vibrations 170 should not interfere with the recipient's perception of the sound vibrations 156. However, it is also important that the tactile vibrations 170 are not too soft so as to ensure the recipient is able to feel the tactile sensation. Accordingly, the techniques presented herein allow hearing care professionals to customize the operation settings of the bone conduction device 100, so that the tactile vibrations occur in frequencies and at a gain level that is tailored to the specific recipient 109. It could also be that the recipient 109 has the ability to turn the tactile vibrations 170 on or off, depending on the situation.

In accordance with certain embodiments presented herein, the amount of vibration delivered as a result of the tactile vibrations 170 could be set/customized so that the bone conduction device 100 does not vibrate too much (so it disrupts/irritates the user) or too little (so the user can feel it), and doesn't interfere with the ability to hear. Such customization of the vibro-tactile feedback module 164 to generate tactile vibrations 170 in a manner that is appropriate for the recipient 109 can be done in parallel to programming of the sound processing module 150. When programming bone conduction sound processors, such as sound processing module 150, the hearing care professional sends signals with varying gain to various frequencies to the bone conduction device 100, worn by the recipient, for generation of sound vibrations 156. The recipient indicates when he/she can hear (or not hear) the signals. Similarly, when programming the vibro-tactile feedback module 164, the hearing care professional could send signals to the bone conduction device 100, worn by the recipient, for generation of tactile vibrations 170. The recipient 109 can then be asked to indicate if they can feel (or not feel) the tactile vibrations 170, and whether they experience them as sound (rather than as a vibro-tactile sensation). In addition, when programming the sound processing module 150, the hearing care professional and the recipient can discuss which other features should be turned on or off, for each program. This is where they would also discuss whether the vibro-tactile feature should be turned on for all programs, or just for certain programs.

For example, in accordance with certain embodiments presented herein the tactile vibrations 170 could be selectively activated/deactivated by the recipient 109, for example, through an input received at the interface module 162, through a voice command, etc., so that the recipient can select the situations in which he/she would like to receive the tactile vibrations contemporaneously with the sound vibrations.

In accordance with other embodiments presented herein, the tactile vibrations could also or alternatively be selectively activated/deactivated based on one or more features/attributes of the received sound signals. In particular, the processing unit 148 (e.g., the sound processing module 150) may be configured to determine or extract one or more features of the received sound signals and then activate/deactivate, or even set the tactile vibrations 170, based on the determined features of the received sound signals. These features of the received sound signals may include, for example, one or more frequencies of the received sound signals (e.g., fundamental frequency, maximum frequency, minimum frequency, average frequency, etc.), one or more amplitudes of the received sound signals (e.g., maximum amplitude, minimum amplitude, average amplitude, etc.), one or more energy levels of the received sound signals (e.g., peak energy, average energy, etc.), an environmental classification of the received sound signals, etc. In such embodiments, if the determined features match predetermined criteria, then the vibro-tactile feedback module 161 could be selectively activated to generate the tactile output signals 166. Selectively activation of the vibro-tactile feedback module 161 is shown in FIG. 1B by dashed arrow 171, where arrow 171 may represent an on/off indication and/or may include information indicating how the tactile vibrations 170 should be generated (i.e., indicating selected attributes of the tactile vibrations).

In accordance with one specific example, the tactile vibrations 170 may be selectively activated or set based on an environmental classification of the received sound signals. More specifically, in certain such examples, the processing unit 148 (e.g., sound processing module 150) includes an environmental classification module (environmental classifier), which is represented in FIG. 1B by dashed box 175. In this example, the environmental classifier 175 receives the electrical signals 122 output by the microphone(s) 126. Using these electrical signals, the environmental classifier 175 is configured to evaluate/analyze the received sound signals (sounds) 121 and determine the sound class/category/environment of the sounds. That is, the environmental classifier 175 is configured to use the received sounds to "classify" the ambient sound environment and/or the sounds into one or more sound categories (i.e., determine the input signal type). The sound class or environment may include, but are not limited to, "Speech" (e.g., the sound signals include primarily speech signals), "Noise" (e.g., the sound signals include primarily noise signals), "Speech+Noise" (e.g., both speech and noise are present in the sound signals), "Wind" (e.g., e.g., the sound signals include primarily wind signals), "Music" (e.g., the sound signals include primarily music signals), and "Quiet" (e.g., the sound signals include minimal speech or noise signals). The environmental classifier 175 (or another element) may also estimate the signal-to-noise ratio (SNR) of the sound signals.

In one example, the environmental classifier 175 generates sound classification information/data representing the sound class of the sound signals and, in certain examples, the SNR of the sound signals. This sound classification data can be used to activate/deactivate the vibro-tactile feedback module 164. For example, the vibro-tactile feedback module 164 could be selectively activated to generate tactile output signals 166 when the environmental classifier 175 determines that the ambient sound environment is a "Speech" or "Speech+Noise" environment. Additionally or alternatively, the vibro-tactile feedback module 164 could be selectively deactivated when the environmental classifier 175 determines that the ambient sound environment is a "Quiet" environment. Selectively activation/deactiation of the vibro-tactile feedback module 161 based on the sound classification data is shown in FIG. 1B by dashed arrow 173, where arrow 173 may represent an on/off indication and/or may include information indicating how the tactile vibrations 170 should be generated (i.e., indicating selected attributes of the tactile vibrations.

Figure 3:
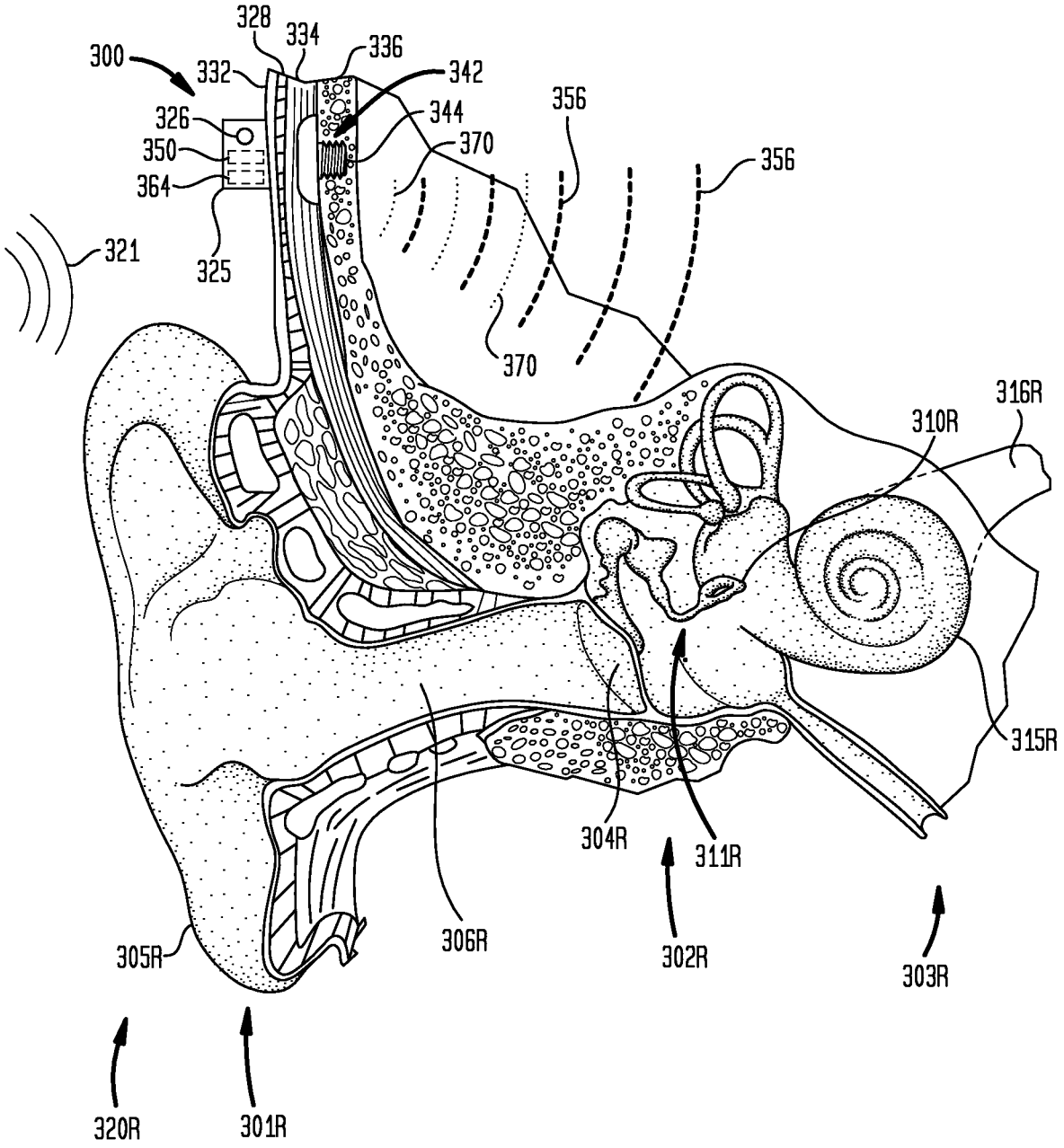
FIG. 3 is a perspective view of an alternate exemplary bone conduction device in which at least some embodiments presented herein can be implemented.

As noted above, FIG. 1A illustrates a percutaneous bone conduction device 100. It is to be appreciated that certain aspects presented herein may be utilized with other types of bone conduction devices. For example, FIG. 3 is a perspective view of a "transcutaneous bone conduction device" 300 in which embodiments presented herein can be implemented. A transcutaneous bone conduction device is a bone conduction device that does not use a percutaneous abutment. Instead, the transcutaneous bone conduction device is held against the skin via a magnetic coupling (e.g., magnetic material and/or magnets being implanted in the recipient and the vibrator having a magnet and/or magnetic material to complete the magnetic circuit, thereby coupling the vibrator to the recipient).

More specifically, FIG. 3 also illustrates the positioning of transcutaneous bone conduction device 300 relative to a deaf ear 320R of a recipient 309. Similar to the recipient 109 of FIG. 1A, the deaf ear 320R includes an outer ear 301R with an auricle 305R, an ear canal 306R, and a tympanic membrane 304R; middle ear 302R with ossicles 311R; and an inner ear 303R with an oval window 310R and a cochlea 315R. Recipient 309 also includes a functional ear which, for ease of illustration, has been omitted from FIG. 3.

The cochlea 315R of deaf ear 320R is deaf (non-functional), meaning that the cochlea 315R is unable to generate nerve impulses to be transferred through the spiral ganglion cells to the auditory nerve 316R. The cochlea 315R may be deaf as a result of sensorineural hearing loss due to the absence or destruction of the hair cells in the cochlea 315R that transduce the sound signals (i.e., waves of fluid motion within cochlea 315R) into the nerve impulses.

As shown, bone conduction device 300 is positioned behind outer ear 301R of the recipient and comprises a housing 325 having one or more microphones 326 positioned therein or thereon. The one or more microphones 326 may also or alternatively be located on a cable extending from bone conduction device 100, physically separated from the bone conduction device (e.g., an in-the-ear microphone in wireless communication with the bone conduction device), etc.

In accordance with the embodiment of FIG. 3, a fixation system 344 may be used to secure an implantable component 342 to skull 336. The fixation system 344 may be a bone screw fixed to skull 336, and also attached to implantable component 342, below the recipient's muscle 334, fat 328 and skin 332.

In the arrangement of FIG. 3, the bone conduction device 300 is a passive transcutaneous bone conduction device. That is, no active components, such as the actuator, are implanted beneath the recipient's skin 332. Instead, the active actuator (e.g., electromagnetic actuator, piezoelectric actuator, etc.) is located in the housing 325 and the implantable component 342 includes a magnetic plate. The magnetic plate of the implantable component 342 vibrates in response to vibrations transmitted through the skin, mechanically and/or via a magnetic field, that are generated by the magnetic component (plate) in the bone conduction device 300.

In particular, in addition to the one or more microphones 326 and the actuator, the housing 325 includes a sound processing module 350, vibro-tactile feedback module 364, amplifier, magnetic component, battery, and/or various other electronic circuits/devices. For ease of representation, the amplifier, actuator, magnetic component, battery, and any other electronic circuits/devices have been omitted from FIG. 3.

Similar to bone conduction device 100 of FIG. 1A, in FIG. 3 the one or more microphones 326 convert received sound signals 321 into electrical signals. These electrical signals are processed by the sound processing module 350. The sound processing module 350 is configured to convert the electrical signals from the microphone(s) 326 into adjusted/processed electrical signals. That is, the sound processing module 350 is configured to apply one or more processing operations (e.g., filtering, noise reduction, automatic gain control/adjustment, loudness compression, etc.) to the electrical signals from the one or more microphones 326.

The processed electrical signals generated by the sound processing module 350 are provided to the amplifier. The amplifier amplifies (i.e., increases the time-varying voltage or current) the processed electrical signals to generate amplified output signals, sometimes referred to herein as "sound vibration control signals." The sound vibration control signals are then used to drive (activate) the actuator in a manner that causes the recipient 309 to perceive the sound signals 321. That is, using the sound vibration control signals, the actuator generates a mechanical output force that is delivered to the skull of the recipient 309 via coupling assembly 140. Delivery of this output force causes one or more of motion or vibration of the recipient's skull, which are collectively and generally referred to herein as "sound vibrations" to the recipient's skull.

As noted elsewhere herein, single-sided deafness (SSD) is a common condition in which a recipient has profound hearing loss in one ear (i.e., one ear is clinically deaf), but retains hearing in the contralateral ear (i.e., one ear is functional). When a bone conduction device, such as bone conduction device 300, is used to treat single-sided deafness, the bone conduction device 300 is configured to represent the received sound signals 321 as sound vibrations (i.e., vibrations representing the sound signals 321) that are sent/transmitted through the skull bone 336, from the deaf ear side of the head (i.e., proximate to deaf ear 3120R) to the contralateral functional cochlea. The sound vibrations, which are represented in FIG. 3 by lines 356, set up waves of fluid motion within the contralateral functional cochlea. Such fluid motion, in turn, activates the hair cells inside of the contralateral functional cochlea, which causes appropriate nerve impulses to be transferred through the spiral ganglion cells and auditory nerve to the brain, where they are perceived as sound. As a result, the recipient 309 is able to perceive the sound signals 321 (albeit at the opposite side of the head from which they are received).

As noted, bone conduction device 300 also comprises a vibro-tactile feedback module 364, which is configured to cause the amplifier and actuator to generate and deliver tactile vibrations, sometimes referred to herein as "vibro-tactile feedback," to the recipient 309. That is, the vibro-tactile feedback module 364 generates tactile output signals that are provided to the amplifier. The amplifier amplifies (i.e., increases the time-varying voltage or current) the tactile output signals to generate "tactile vibration control signals." The tactile vibration control signals are then used to drive (activate) the actuator in a manner that causes the recipient 309 to feel/sense tactile vibrations, which are represented in FIG. 3 by dashed lines 370, proximate to the deaf ear 320R. The recipient 309 would be able to feel this vibration via their skin and/or via their bone. The vibration would not be instead of, but rather in addition to the sound vibrations 356 used to evoke perception of the sound signals 321. In this way, the recipient 309 is able to both feel and hear the sound originating on the deaf side, in a similar manner as detailed above with reference to bone conduction device 100 of FIGS. 1A, 1B, and 2.

In particular, as described above, the tactile vibrations 370 (vibro-tactile feedback) are delivered to the recipient 309 at one or more of a frequency or amplitude/magnitude (i.e., generated with a gain) that results in the recipient 309 "feeling" the tactile vibrations proximate to the deaf ear 320L, but not hearing, the tactile vibrations at the contralateral functional ear. That is, in the embodiment of FIG. 3, the recipient 309 experiences a vibro-tactile sensation (e.g., tingling) adjacent/proximate to the bone conduction device 300 (e.g., proximate to right ear 320R) upon the delivery of the tactile vibrations 370, but the tactile vibrations 370 do not evoke a hearing percept at the functional contralateral cochlea (i.e., certain frequency levels and/or amplitudes of vibration leave the recipient 309 feeling the vibration of sound, rather than hearing the sound. This is in contrast to the sound vibrations 356, which evoke a hearing percept at the functional contralateral cochlea, but which are not felt by the recipient 309.

Figure 4:
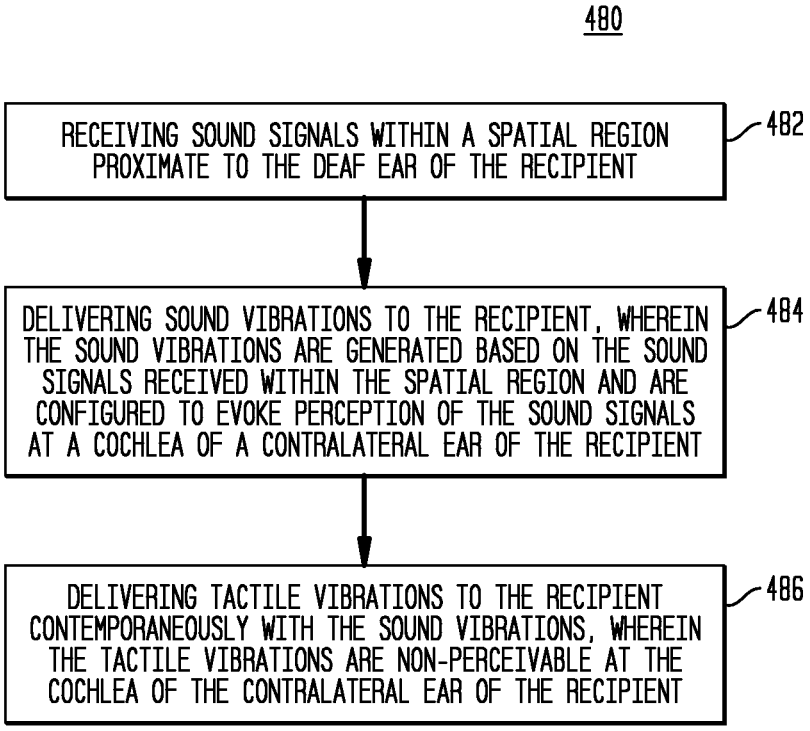
FIG. 4 is a flowchart of a method, in accordance with certain embodiments presented herein.

FIG. 4 is a flowchart of a method 480, in accordance with embodiments presented herein. Method 480 begins at 482 where sound signals (sounds) are received, by a bone conduction device positioned at a deaf ear of a recipient, within a spatial region proximate to the deaf ear of the recipient. At 484, the bone conduction device delivers sound vibrations to the recipient, wherein the sound vibrations are generated based on the sound signals received within the spatial region and are configured to evoke perception of the sound signals at a cochlea of a contralateral ear of the recipient. At 486, the bone conduction device delivers tactile vibrations to the recipient contemporaneously with the sound vibrations, wherein the tactile vibrations are non-perceivable at the cochlea of the contralateral ear of the recipient.

Figure 5:
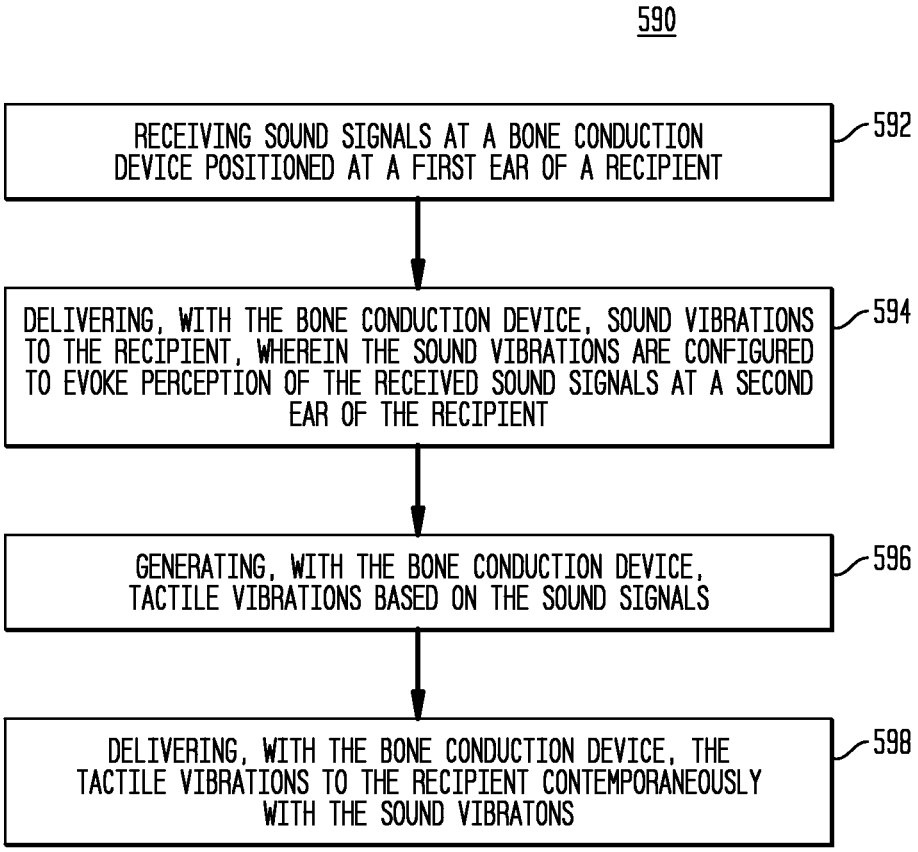
FIG. 5 is a flowchart of another method, in accordance with certain embodiments presented herein.

FIG. 5 is a flowchart of another method 590, in in accordance with embodiments presented herein. Method 590 begins at 592 where a bone conduction device positioned at a first ear of a recipient receives sound signals. At 594, the bone conduction device delivers sound vibrations to the recipient, wherein the sound vibrations are configured to evoke perception of the received sound signals at a second ear of the recipient. At 596, the bone conduction device generates tactile vibrations based on the sound signals. At 598, the bone conduction device delivers the tactile vibrations to the recipient contemporaneously with the sound vibrations.

It is to be appreciated that the embodiments presented herein are not mutually exclusive.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method, comprising:

at a bone conduction device positioned at a deaf ear of a recipient:

receiving sound signals within a spatial region proximate to the deaf ear of the recipient;

delivering sound vibrations to the recipient, wherein the sound vibrations are generated based on the sound signals received within the spatial region and are configured to evoke perception of the sound signals at a cochlea of a contralateral ear of the recipient; and delivering tactile vibrations to the recipient contemporaneously with the sound vibrations adjacent to the deaf ear of the recipient and away from the contralateral ear of the recipient to avoid perception of the tactile vibrations by the recipient at the cochlea of the contralateral ear of the recipient.

2. The method of claim 1, wherein the sound vibrations are delivered at one or more frequencies, and wherein delivering the tactile vibrations comprises:

delivering the tactile vibrations at one or more frequencies that are below the one or more frequencies of the sound vibrations.

3. The method of claim 1, wherein the sound vibrations are delivered at one or more amplitudes, and wherein delivering the tactile vibrations further comprises:

delivering the tactile vibrations at one or more amplitudes that are above the one or more amplitudes of the sound vibrations.

4. The method of claim 1, wherein the sound vibrations are associated with one or more frequencies that are above a first threshold, and wherein delivering the tactile vibrations comprises:

delivering the tactile vibrations at one or more frequencies that are below the first threshold.

5. The method of claim 4, wherein the first threshold is an estimated minimum hearing threshold of the recipient.

6. The method of claim 5, further comprising:

determining the estimated minimum hearing threshold of the recipient based on at least one of an objective measurement or a subjective measurement of residual hearing capabilities of the recipient.

7. The method of claim 1, further comprising:

generating the tactile vibrations based on the sound signals received within the spatial region.

8. The method of claim 7, wherein generating the tactile vibrations based on the sound signals received within the spatial region comprises:

generating a substantial copy of the sound vibrations at a frequency that is lower than corresponding frequencies of the sound vibrations.

9. The method of claim 8, wherein generating the substantial copy of the sound vibrations at the frequency that is lower than the corresponding frequencies of the sound vibrations comprises:

generating the substantial copy of the sound vibrations with a gain that is higher than corresponding gains of the sound vibrations.

10. The method of claim 1, further comprising:

generating the tactile vibrations in accordance with a predetermined pattern.

11. The method of claim 1, wherein delivering the tactile vibrations to the recipient contemporaneously with the sound vibrations comprises:

generating the tactile vibrations only in response to receipt of a user input.

12. The method of claim 1, wherein delivering the tactile vibrations to the recipient contemporaneously with the sound vibrations comprises:

determining one or more features of the sound signals received within the spatial region; and selectively generating the tactile vibrations only when at least one of the one or more features of the sound signals received within the spatial region match predetermined criteria.

13. The method of claim 12, wherein the one or more features of the sound signals comprises an environmental classification of the sound signals.

14. A bone conduction device, comprising:

one or more sound input elements configured to receive sound signals within a spatial region proximate to a first ear of a recipient;

an actuator; and a processing unit and amplifier collectively configured to:

convert the sound signals into one or more sound output signals for use in driving the actuator to evoke perception of the sound signals at a cochlea of a second ear of the recipient;

determine an environmental classification of the sound signals; and based on the environmental classification of the sound signals, generate vibro-tactile output signals for use in driving the actuator to evoke a vibro-tactile sensation proximate to the first ear of the recipient.

15. The bone conduction device of claim 14, wherein the vibro-tactile sensation is non-perceivable at the cochlea of the second ear of the recipient.

16. The bone conduction device of claim 14, wherein the vibro-tactile sensation is evoked proximate to the first ear contemporaneously with the perception of the sound signals at the cochlea of the second ear of the recipient.

17. The bone conduction device of claim 14, wherein the perception of the sound signals at the cochlea of the second ear of the recipient is evoked in response to delivery of sound vibrations to the recipient via the actuator, and wherein the vibro-tactile sensation is evoked in response to delivery of tactile vibrations to the recipient via the actuator.

18. The bone conduction device of claim 17, wherein the sound vibrations are generated by the actuator at a first frequency and the tactile vibrations are generated by the actuator at a second frequency that is less than the first frequency.

19. The bone conduction device of claim 18, wherein the second frequency is below a minimum frequency of hearing of the recipient.

20. The bone conduction device of claim 18, wherein the one or more sound output signals for use in driving the actuator are generated in accordance with a first gain, and wherein the vibro-tactile output signals are generated in accordance with a second gain that is different from the first gain.

21. The bone conduction device of claim 20, wherein the second gain is greater than the first gain.

22. The bone conduction device of claim 18, wherein to generate the vibro-tactile output signals for use in driving the actuator to evoke the vibro-tactile sensation proximate to the first ear of the recipient, the processing unit and the amplifier are configured to:

generate the vibro-tactile output signals based on the sound signals received within the spatial region.

23. The bone conduction device of claim 22, wherein to generate the vibro-tactile output signals based on the sound signals received within the spatial region, the processing unit and the amplifier are configured to:

generate a substantial copy of the one or more sound output signals at a frequency that is lower than a corresponding frequency of the one or more sound output signals.

24. One or more non-transitory computer readable storage media encoded with instructions that, when executed by a processor, cause the processor to:

generate, based on sound signals received at a bone conduction device positioned at a deaf ear of a recipient, one or more sound output signals for use in driving an actuator to generate sound vibrations, wherein the sound signals are received only within a spatial region adjacent to the deaf ear of the recipient and wherein the one or more sound output signals are configured such that the sound vibrations are generated at one or more frequencies to evoke perception of the sound signals at a cochlea of a contralateral ear of the recipient; and based on a user input, generate one or more vibro-tactile output signals for use in driving the actuator to generate tactile vibrations contemporaneously with the sound vibrations, wherein the one or more vibro-tactile output signals are configured such that the tactile vibrations are generated at one or more frequencies that are lower than the one or more frequencies of the sound vibrations.

25. The one or more non-transitory computer readable storage media of claim 24, wherein the one or more vibro-tactile output signals are configured such that the tactile vibrations are non-perceivable at the cochlea of the contralateral ear of the recipient.

26. The one or more non-transitory computer readable storage media of claim 24, wherein the one or more vibro-tactile output signals are configured such that the tactile vibrations are generated at the one or more frequencies lower than the one or more frequencies of the sound vibrations and below a minimum frequency of hearing of the recipient.

27. The one or more non-transitory computer readable storage media of claim 24, wherein the one or more sound output signals are configured such that the sound vibrations are generated with a first gain, and wherein the one or more vibro-tactile output signals are configured such that the tactile vibrations are generated in accordance with a second gain that is different from the first gain.

28. The one or more non-transitory computer readable storage media of claim 27, wherein the second gain is greater than the first gain.

29. The one or more non-transitory computer readable storage media of claim 24, wherein the instructions executable by the processor to cause the processor to generate the one or more vibro-tactile output signals comprise instructions that, when executed by the processor, cause the processor to:

generate the one or more vibro-tactile output signals based on the sound signals received within the spatial region.

30. The one or more non-transitory computer readable storage media of claim 29, wherein the instructions executable by the processor to cause the processor to generate the one or more vibro-tactile output signals based on the sound signals received within the spatial region comprise instructions that, when executed by the processor, cause the processor to:

generate the one or more vibro-tactile output signals within a substantially same content as the one or more sound output signals, wherein the one or more vibro-tactile output signals are associated with a frequency that is lower than a corresponding frequency of the one or more sound output signals and a gain that is higher than a corresponding gain of the one or more sound output signals.

* * * * *